US011371804B2

(12) United States Patent
Evans

(10) Patent No.: US 11,371,804 B2
(45) Date of Patent: Jun. 28, 2022

(54) ADJUSTABLE FASTENING SYSTEM

(71) Applicant: Edge-Works Manufacturing Co., Burgaw, NC (US)

(72) Inventor: Scott V Evans, Jacksonville, NC (US)

(73) Assignee: Edge-Works Manufacturing Company, Burgaw, NC (US)

( * ) Notice: Subject to any disclaimer, the term of this patent is extended or adjusted under 35 U.S.C. 154(b) by 3 days.

(21) Appl. No.: 16/673,653

(22) Filed: Nov. 4, 2019

(65) Prior Publication Data

US 2020/0141692 A1 May 7, 2020

Related U.S. Application Data

(60) Provisional application No. 62/754,955, filed on Nov. 2, 2018.

(51) Int. Cl.

| | |
|---|---|
| ***F41C 33/02*** | (2006.01) |
| ***F41C 33/00*** | (2006.01) |
| *A45F 5/02* | (2006.01) |

(52) U.S. Cl.

CPC ..... *F41C 33/006* (2013.01); *A45F 5/021* (2013.01); *A45F 2005/025* (2013.01)

(58) Field of Classification Search

CPC ... F41C 33/006; A45F 5/021; A45F 2005/025

USPC ..... 224/191

See application file for complete search history.

(56) References Cited

U.S. PATENT DOCUMENTS

| | | | | |
|---|---|---|---|---|
| 3,586,355 | A * | 6/1971 | Magi | F16C 11/10 403/91 |
| 4,504,001 | A * | 3/1985 | Nichols | F41C 33/045 224/198 |
| 5,542,151 | A * | 8/1996 | Stranski | A47D 13/063 16/326 |
| 5,887,935 | A * | 3/1999 | Sack | B62B 9/104 296/122 |
| 6,010,045 | A * | 1/2000 | Rogers | F41C 33/041 224/197 |
| 6,170,910 | B1 * | 1/2001 | Bapst | A47C 7/66 16/377 |
| 8,104,141 | B2 * | 1/2012 | Yamashita | B60N 2/2352 16/239 |
| 8,475,073 | B1 * | 7/2013 | Rodriguez | E05D 11/06 403/119 |
| 8,720,753 | B2 * | 5/2014 | Beneš | F41C 33/0236 224/244 |
| 8,783,532 | B2 * | 7/2014 | Gregory | F41C 33/045 224/198 |
| 10,554,238 | B2 * | 2/2020 | Qi | H05K 5/0204 |
| 2008/0172841 | A1 * | 7/2008 | Babasaki | A45F 5/02 24/3.12 |

(Continued)

*Primary Examiner* — Peter N Helvey

(74) *Attorney, Agent, or Firm* — Intellectual Property Consulting, LLC; Ian C. Barras

(57) ABSTRACT

An adjustable fastening system comprising a mounting bracket, wherein said mounting side comprises an outer flange, an inner raised portion, and a plurality of retention pegs; a clip, wherein a side of said clip comprises a plurality of retention holes; and a fastener; wherein said clip is operable to be mounted to said mounting bracket such that said retention holes receive said retention pegs; and wherein said fastener is operable to secure said clip to said mounting bracket such that said mounting bracket and said clip are secured to one another.

22 Claims, 9 Drawing Sheets

(56) References Cited

U.S. PATENT DOCUMENTS

| | | | | |
|---|---|---|---|---|
| 2011/0168748 | A1* | 7/2011 | Benes | F41C 33/045<br>224/244 |
| 2012/0037673 | A1* | 2/2012 | Chen | A45C 11/00<br>224/191 |
| 2013/0240582 | A1* | 9/2013 | Tyybakinoja | F41C 33/0263<br>224/244 |
| 2019/0097666 | A1* | 3/2019 | Qi | H04M 1/06 |

* cited by examiner

ADJUSTABLE FASTENING SYSTEM

CROSS-REFERENCE TO RELATED APPLICATIONS

The present application claims priority from U.S. Provisional Application No. 62/754,955, filed Nov. 2, 2018, which is incorporated herein by reference as if set forth in full below.

BACKGROUND OF THE INVENTION

I. Field of the Invention

The invention relates to an adjustable fastening system operable to be configured in multiple positions. Specifically, the invention relates to a system to provide for optimal positioning of accessories attached to clothing or other objects via a clip.

II. General Background

Various items designed to be carried or attached on a belt or other convenient location benefit from an ability to set a variety of secure carrying positions. Many clips and brackets designed to be configurable lack the ability to allow for repositioning while maintaining a stable and secure position that does not require regular tightening or adjustment to maintain the desired position. Thus, there exists a need for an improved retention system that maintains a sturdy and stable position without regular maintenance.

SUMMARY OF THE INVENTION

In accordance with one embodiment, the present invention is an adjustable fastening system, comprising a mounting bracket, said mounting bracket comprising a mounting side and an interior side, wherein said mounting side comprises an outer flange, an inner raised portion, and a plurality of retention pegs; a clip, said clip comprising a mounting portion, a vertical extension, a retention member, and a tab, wherein a side of said mounting portion comprises a plurality of retention holes; and a fastener; wherein said clip is operable to be mounted to said mounting bracket such that said retention holes receive said retention pegs; and wherein said fastener is operable to secure said clip to said mounting bracket such that said mounting bracket and said clip are secured to one another. In one embodiment of the present invention, the retention holes associated with the above-referenced clip comprise a plurality of indentations, wherein said indentations are operable to receive said retention pegs in a plurality of positions, and wherein said indentations prevent rotational movement of said clip when said retention pegs are seated within said indentations.

BRIEF DESCRIPTION OF THE DRAWINGS

The foregoing and other objects, features, and advantages of the invention are apparent from the following detailed description taken in conjunction with the accompanying drawings in which like parts are given like reference numerals and, wherein.

Figure 1:
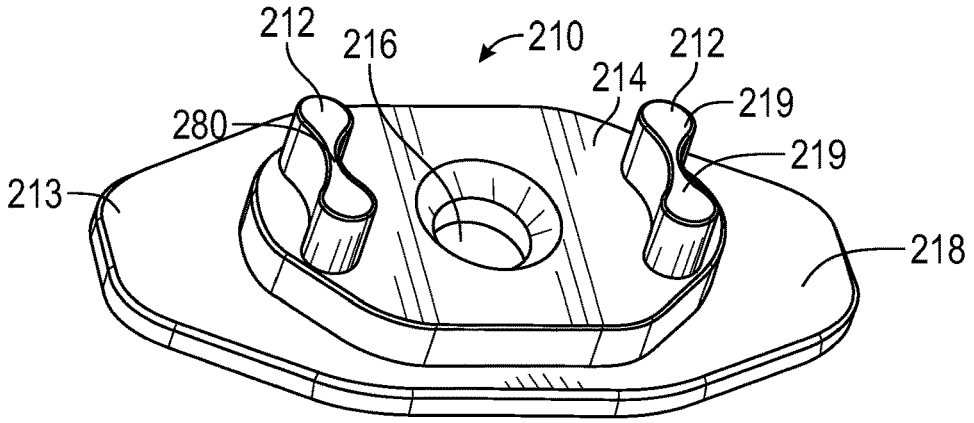
FIG. 1 depicts a perspective view of a mounting side of a mounting bracket.

The images in the drawings are simplified for illustrative purposes and are not depicted to scale. Within the descriptions of the figures, similar elements are provided similar names and reference numerals as those of the previous figure(s). The specific numerals assigned to the elements are provided solely to aid in the description and are not meant to imply any limitations (structural or functional) on the invention.

The appended drawings illustrate exemplary configurations of the invention and, as such, should not be considered as limiting the scope of the invention that may admit to other equally effective configurations. It is contemplated that features of one configuration may be beneficially incorporated in other configurations without further recitation.

DETAILED DESCRIPTION

The embodiments of the disclosure will be best understood by reference to the drawings, wherein like parts are designated by like numerals throughout. It will be readily understood that the components, as generally described and illustrated in the Figures herein, could be arranged and designed in a wide variety of different configurations or be entirely separate. Thus, the following more detailed description of the embodiments of the system and method of the disclosure, as represented in the Figures is not intended to limit the scope of the disclosure, as claimed, but is merely representative of possible embodiments of the disclosure.

The adjustable fastening system of the disclosed invention comprises three primary parts: a mounting bracket, a clip, and a fastener. Turning to the figures, FIG. 1 shows a perspective view of bracket 210, which comprises interior side 211 and mounting side 218, outer flange 213, raised center portion 214, retention points 212, and threaded hole 216. Retention points 212 are connected to, and part of, center portion 214 and are located at equidistant points away from the center of threaded hold 216. Threaded hole 216 is configured to receive fastener 250. In an exemplary embodiment, each retention point 212 is comprised of two pegs 219. In the embodiment shown in FIG. 1, each pair of pegs 219 are connected by a connection bridge 280. In an alternative embodiment (not shown), each pair of pegs 219 are comprised of a pair of independent pegs that are not connected, one to the other, by a bridge 280 or any similar structure. It is understood that greater or fewer pegs may be used in alternative embodiments or configurations.

Figure 2:
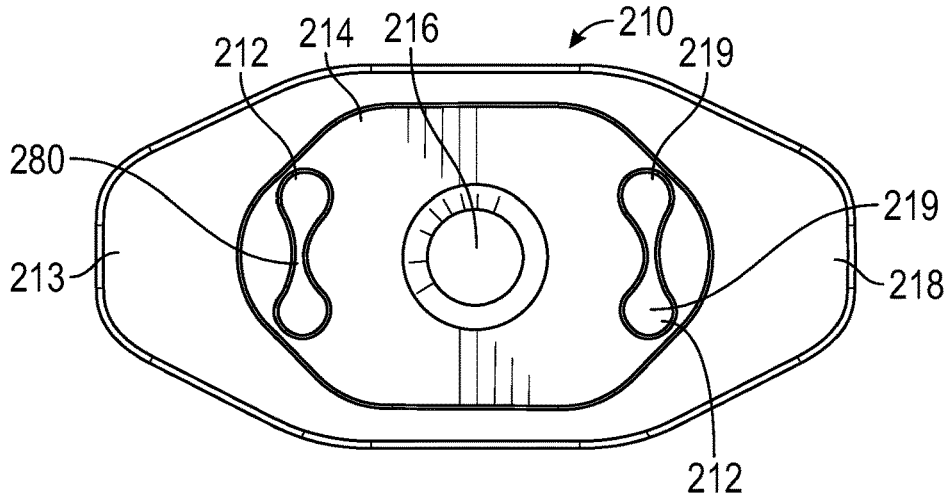
FIG. 2 depicts a plan view of a mounting side of a mounting bracket.
Figure 3:
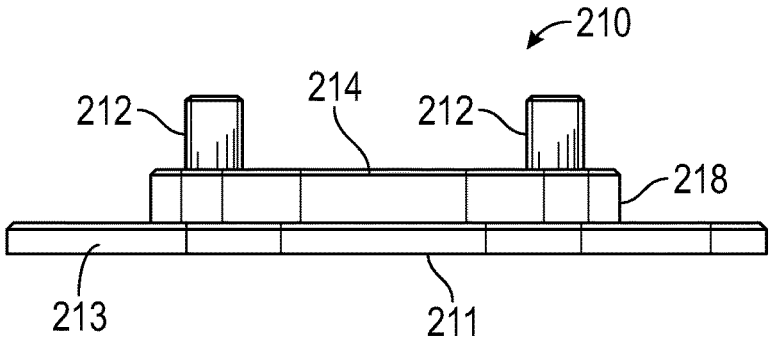
FIG. 3 depicts a lengthways, side view of a mounting bracket.
Figure 4:
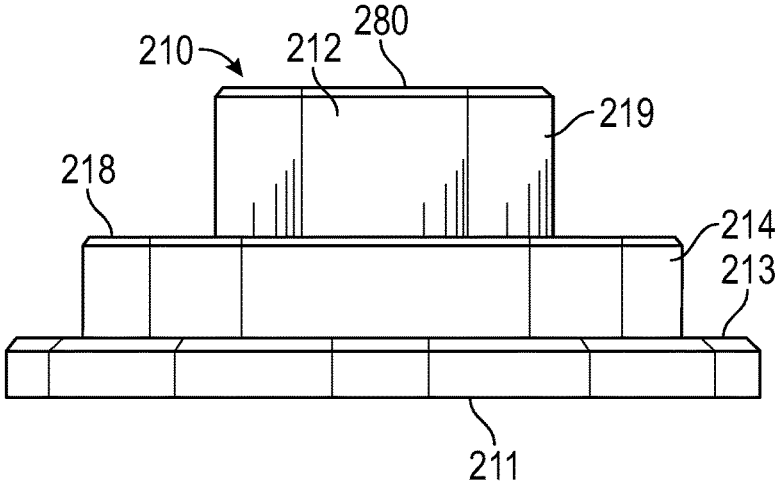
FIG. 4 depicts an end-on, side view of a mounting bracket.
Figure 5:
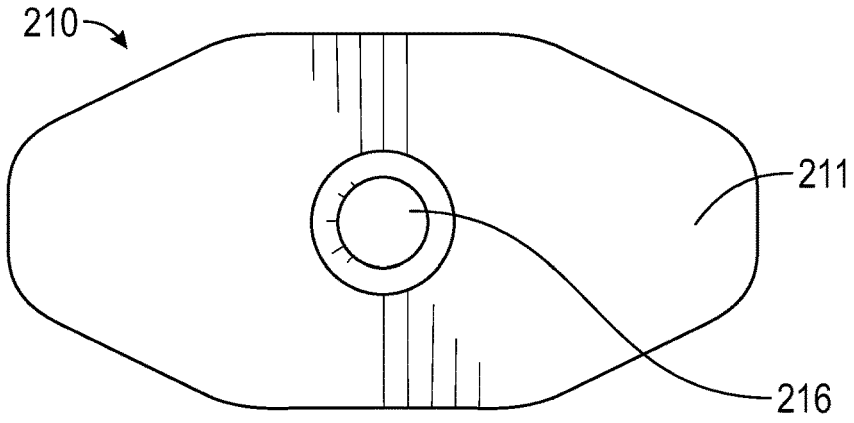
FIG. 5 depicts a plan view of an interior side of a mounting bracket.

FIGS. 2-5*b* show alternative views of bracket 210. Specifically: FIG. 2 shows a plan view of mounting side 218 of bracket 210; FIG. 3 shows a lengthways side view of bracket 210; FIG. 4 shows an end-on side view of bracket 210; FIG. 5 shows a plan view of interior side 211 of bracket 211; and, FIG. 5*b* shows another perspective view of bracket 210.

Figure 6:
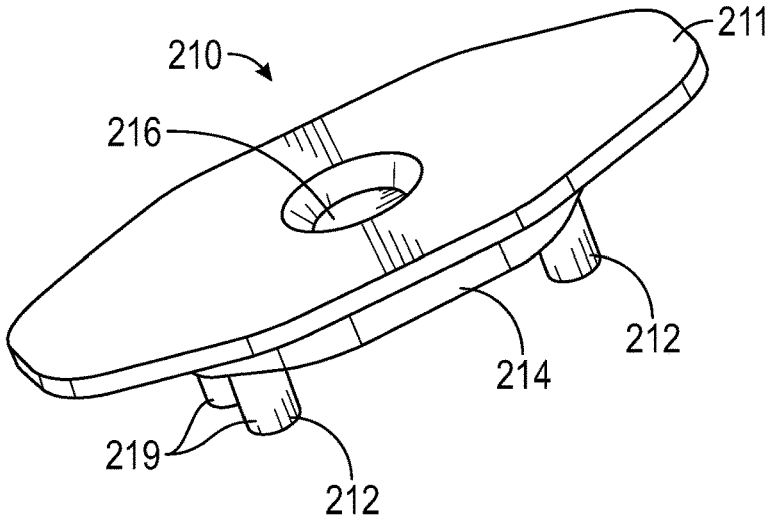
FIG. 6 depicts a perspective view of an interior side of a mounting bracket.

Clip 200 (FIG. 6) comprises a front side 221, a back side 222, a mounting portion 230; a vertical extension 220 connected to, and extending downward from, mounting portion 230; a retention member 215, which is attached to the bottom of vertical extension 220 such that retention member 215 extends in a direction that is roughly perpendicular to vertical extension 220; and, tab 217, which extends down below retention member 215 such that the user is able to pull clip 200 away from whatever clip 200 is attached to (for example, molded holster 100), thereby allowing the accessory (such as molded holster 100) to be slipped onto, or off of, the user's belt. FIG. 6 shows a plan view of back side 222 of clip 200.

Figure 13:
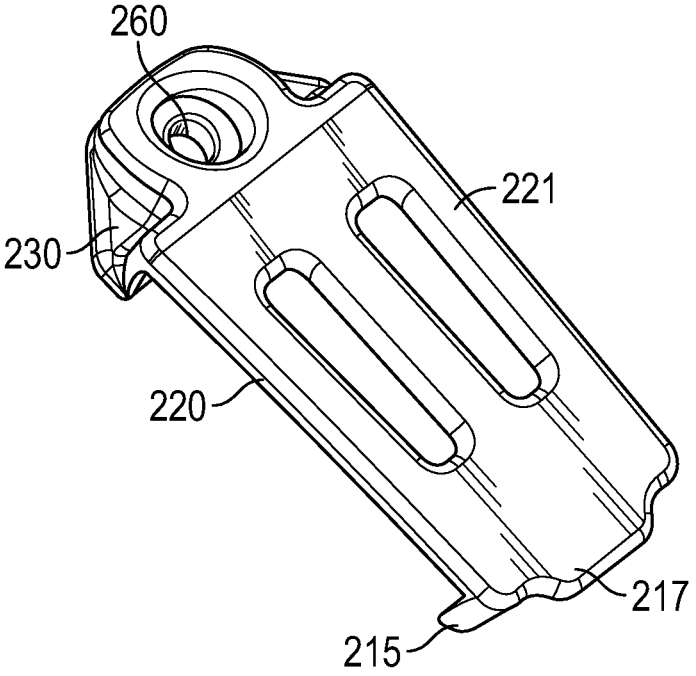
FIG. 13 depicts a perspective view of a front side of a clip.

Clip 200 further comprises retention holes 235 which are comprised of two sets of semi-open circular indentations 214 formed in back side 222 of mounting portion 230, where each said set of indentations 214 are configured in symmetric arcs centered on hole 260 (where hole 260 is configured to receive fastener 250) (see, e.g., FIG. 6). Indentations 214 are configured so that each peg 219 of a retention point 212 fits within its own indentation 214 which also allowing the corresponding bridge 280 to fit within the open spaces between indentations 214 in a given retention hole 235. In an exemplary embodiment, each retention hole 235 comprises five indentations 214; and, when combined with a bracket 210 comprised of retention points 212 each comprising two pegs 219, it is understood that clip 200 is operable to be mounted on bracket 210 in three possible positions: vertically, angled forward, and angled backward (see, e.g., FIGS. 13, 27, and 28, respectively). In alternative embodiments, additional positions could be accommodated by varying the number of retention points 212, retention pegs 219, and/or the number of indentations 214 in each retention hole 235. Once the retention points 212 are seated within their respective retention holes 235, clip 200 cannot rotate relative to bracket 210 once fastener 250 is inserted through hole 260 and screwed into threaded hole 216.

Figure 7:
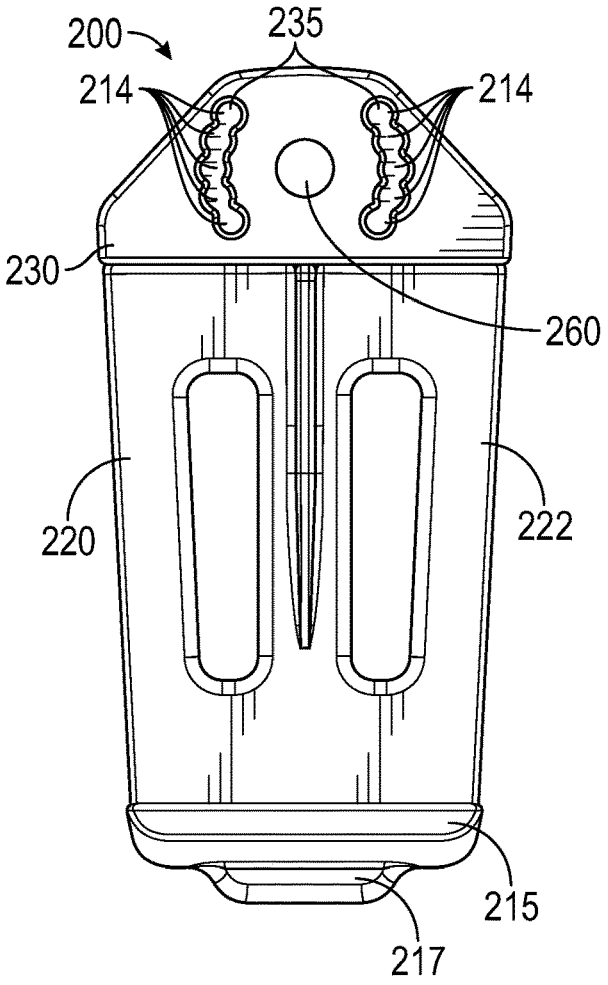
FIG. 7 depicts a plan view of a back side of a clip.
Figure 8:
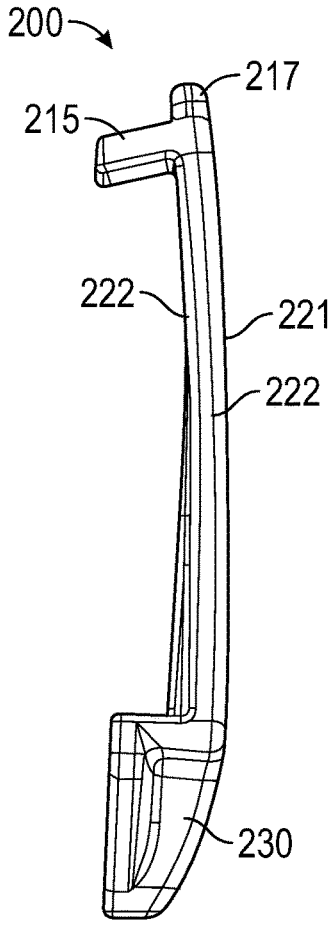
FIG. 8 depicts a lengthways, side view of a clip.
Figure 9:
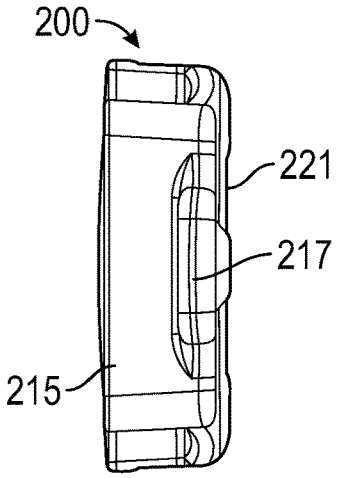
FIG. 9 depicts an end-on, bottom view of a clip.
Figure 10:
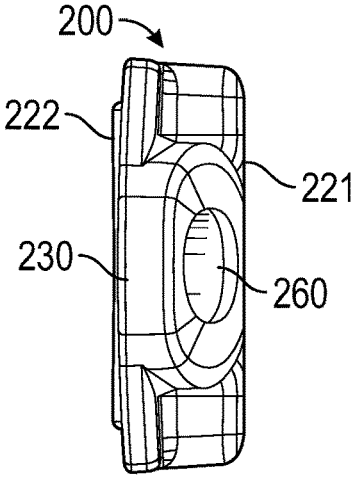
FIG. 10 depicts an end-on, top view of a clip.
Figure 11:
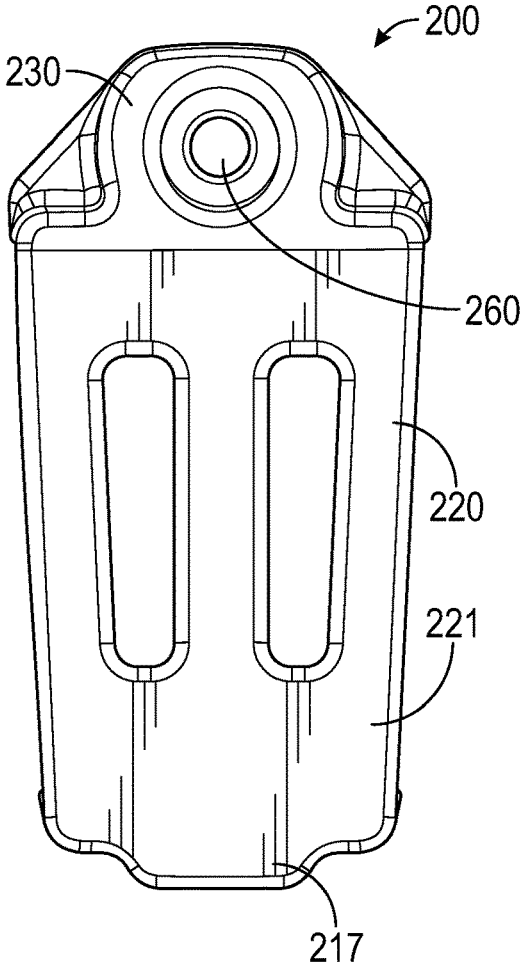
FIG. 11 depicts a plan view of a front side of a clip.
Figure 12:
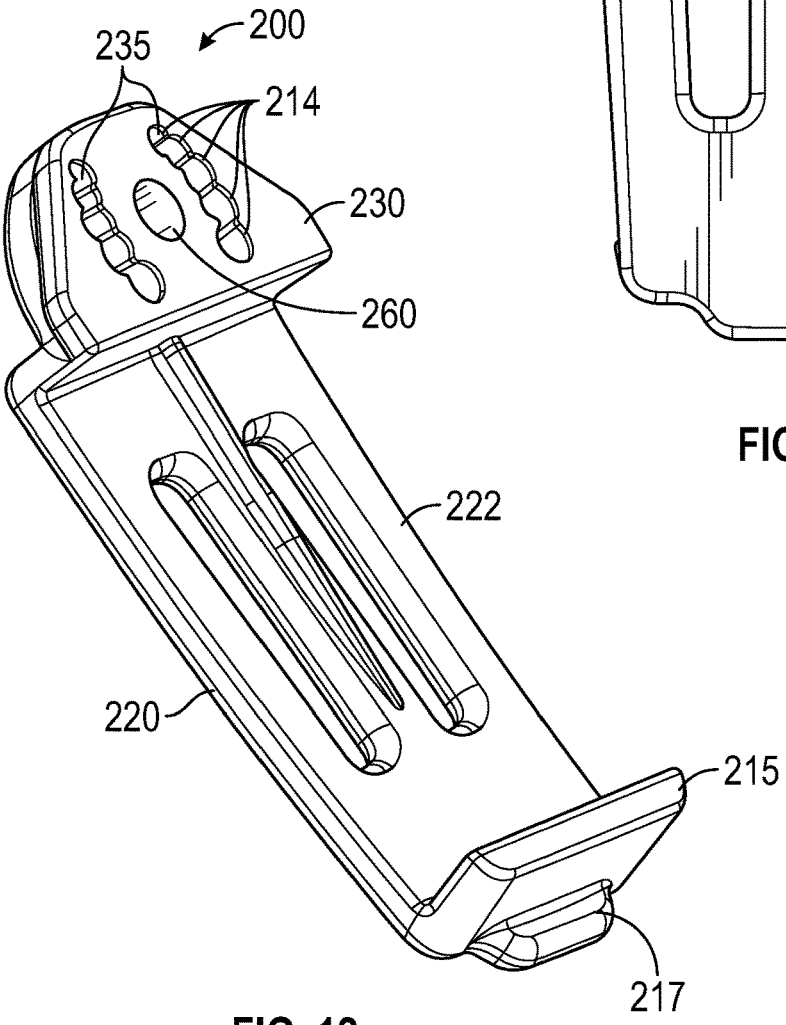
FIG. 12 depicts a perspective view of a back side of a clip.

FIGS. 7-12 show alternative views of clip 200. Specifically: FIG. 7 shows a lengthways side view of clip 200; FIG. 8 shows a bottom, end-on view of clip 200; FIG. 9 shows a top, end-on view of clip 200; FIG. 10 shows a plan view of front side 221 of clip 200; FIG. 11 shows a perspective view of back side 222 of clip 200; and, FIG. 12 shows a perspective view of front side 222 of clip 200.

Figure 14:
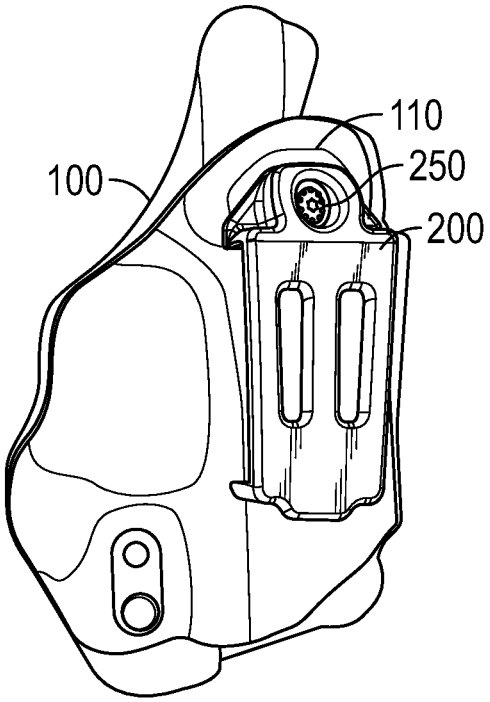
FIG. 14 depicts a perspective view of a clip mounted to a molded holster.
Figure 17:
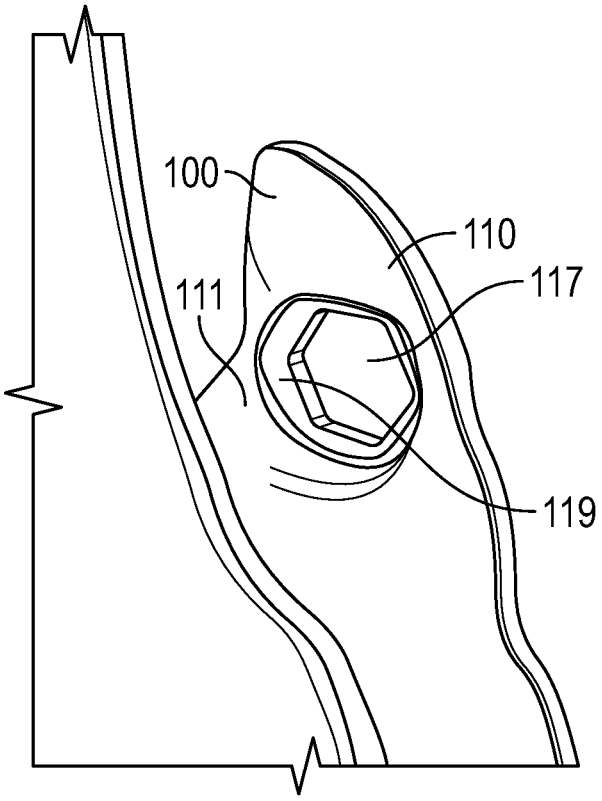
FIG. 17 depicts a partial, perspective view of the interior side of the front of a molded holster, focusing on a mounting point associated with the bracket shown in FIGS. 1-6.
Figure 21:
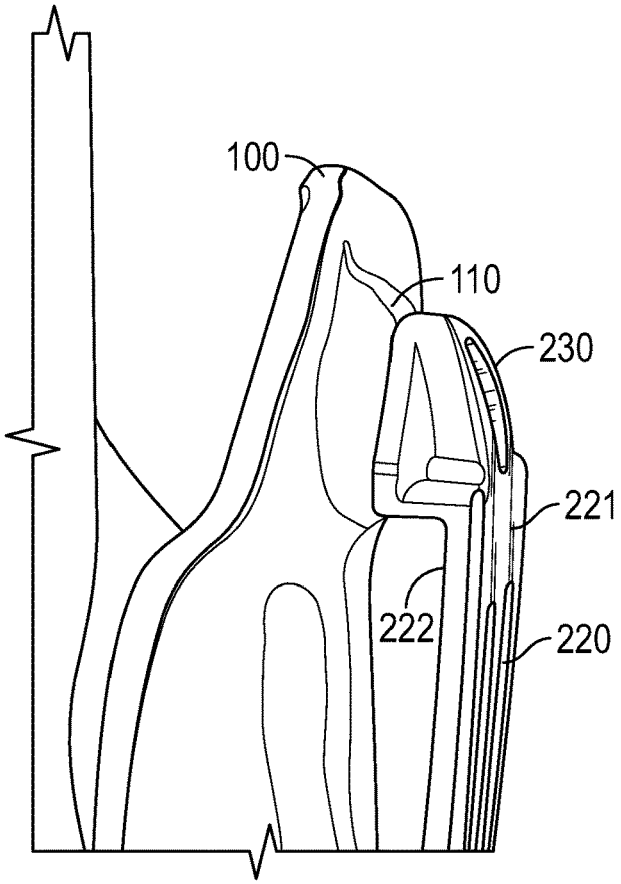
FIG. 21 depicts a partial side view of a clip attached to a molded holster via a fastener (not shown) at the mounting point shown in FIGS. 16 and 17.
Figure 22:
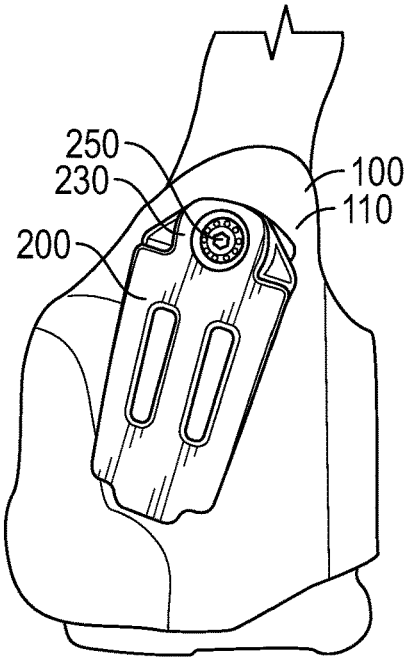
FIG. 22 depicts a front view of a clip attached to a molded holster where the clip is oriented in a forward position.
Figure 23:
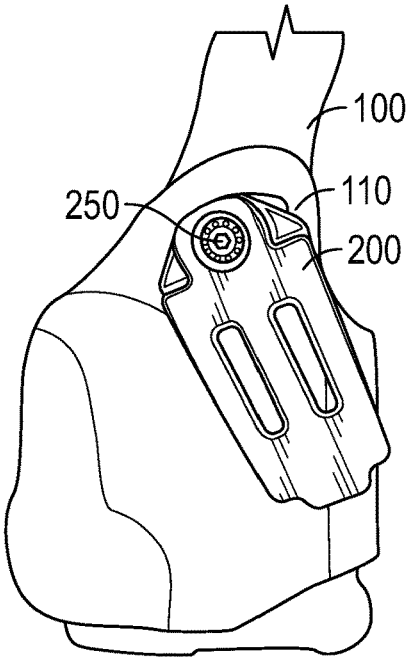
FIG. 23 depicts a front view of a clip attached to a molded holster where the clip is oriented in a rearward position.

In an exemplary embodiment, bracket 210 and clip 200 are attached to molded holster 100 (see FIGS. 13, 14, and 21), which further comprises mounting point 110. Mounting point 110 comprises indentation 119 and hole 117, where indentation 119 is formed on the interior wall 111 of molded holster 100 as a result of the slightly-bulged-out shape of mounting point 118 relative to the rest of front side 115. The slightly-bulged-out shape of mounting point 110 provides clearance from the rest of front side 115 for clip 200 to extend down and around the exterior of the user's pants top and belt (see, e.g., FIG. 17).

Figure 15:
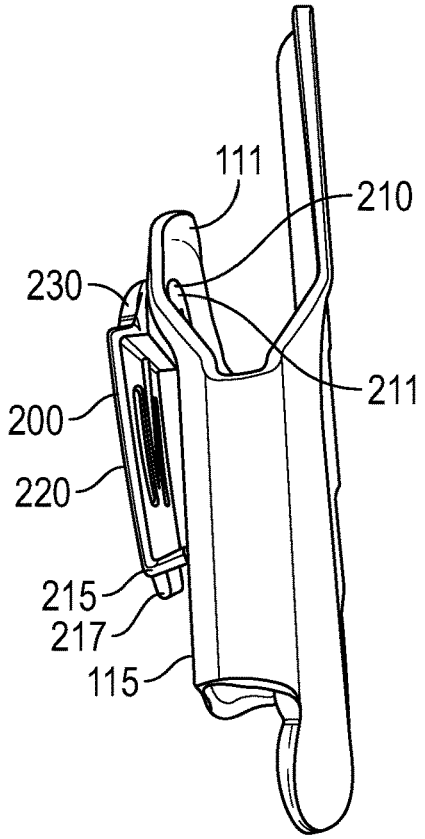
FIG. 15 depicts a side view of a clip counted to a molded holster.
Figure 16:
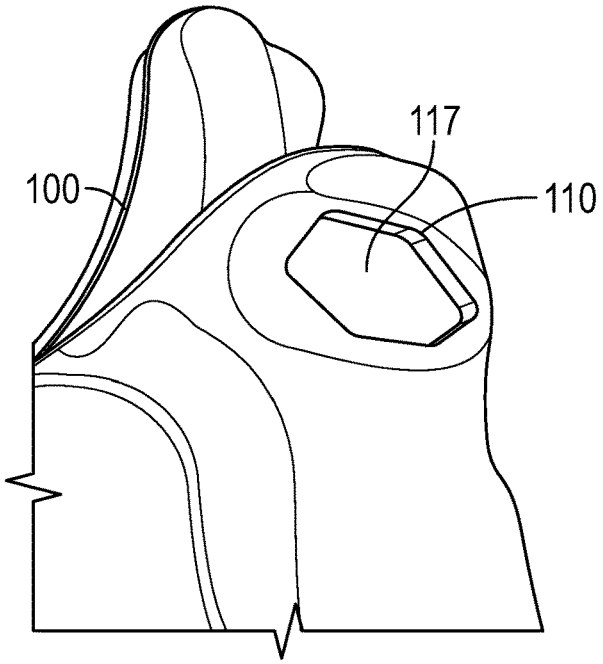
FIG. 16 depicts a partial, perspective view of the front of a molded holster, focusing on a mounting point associated with the bracket shown in FIGS. 1-6.
Figure 18:
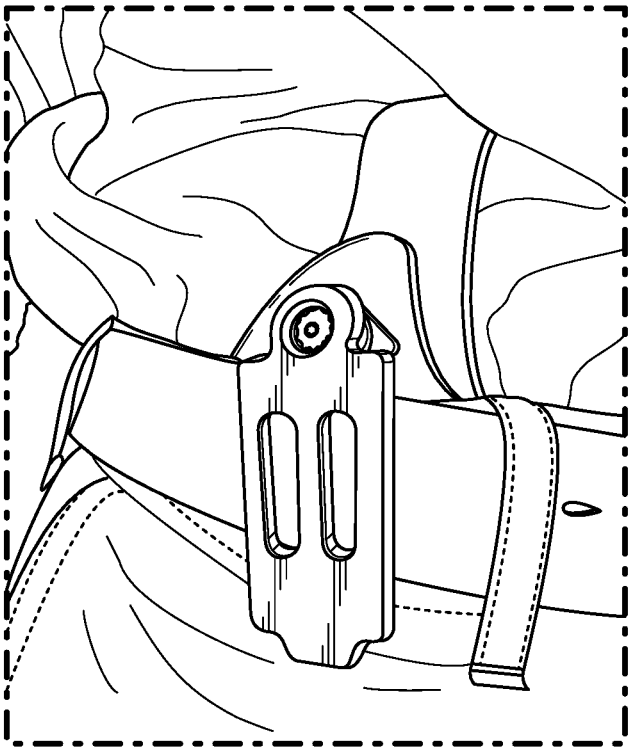
FIG. 18 depicts an example of a clip mounted to a molded holster in place on a user's belt.
Figure 19:
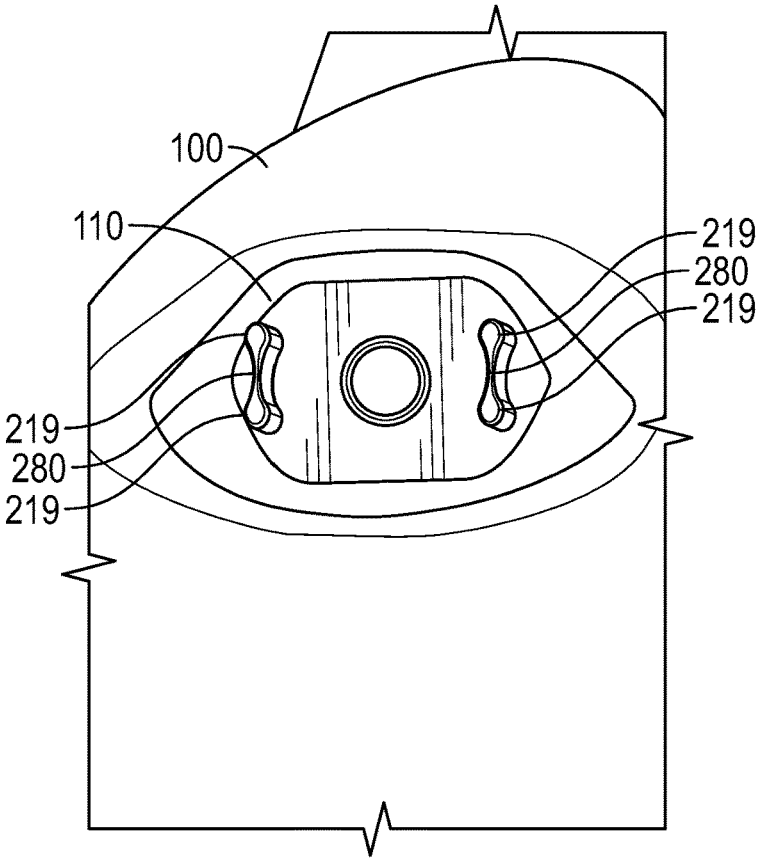
FIG. 19 depicts a partial, front view of a mounting point on a molded holster, where a bracket has been inserted into said mounting point.
Figure 20:
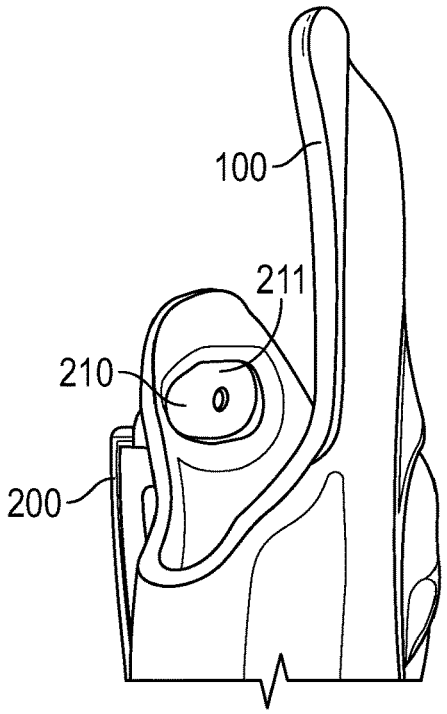
FIG. 20 depicts a first partial, perspective view of the interior of a molded holster, focusing on the interior side of a bracket (see, e.g., FIG. 5) inserted into the indentation and mounting point shown in FIGS. 16 and 17.

Indentation 119 and hole 117 (see, e.g., FIGS. 15 and 16) are shaped and sized to receive bracket 210, which is inserted into indentation 119 so that interior side 211 faces the interior of molded holster 100 and mounting side 218 faces the exterior of molded holster 100 (see FIGS. 18-20). Bracket 210 is sized and shaped so that center portion 214 fits snuggly within hole 117, and outer flange 213 seats within indentation 119 such that bracket 210 cannot rotate within indentation 119 or hole 117 or fit entirely through hole 117 (see FIG. 18 showing center portion 214 seated within hole 117; see FIGS. 19-20 showing interior side 211 of bracket 210, where bracket 210 is seated within indentation 119). Consequently, bracket 210 is securely seated within mounting point 110 and is thus able to serve as a stable point to securely attach mounting clip 200 to molded holster 100 once fastener 250 is inserted through hole 260 of clip 200, and also screwed into threaded hole 216.

What is claimed is:

1. An adjustable fastening system, comprising:

a mounting bracket, said mounting bracket comprising a plurality of retention pegs and a plurality of bridges, wherein each retention peg of said plurality of retention pegs is connected to at least one other retention peg of said plurality of retention pegs by a bridge of said plurality of bridges;

an accessory, said accessory comprising a mounting point; and a clip, said clip comprising a vertical extension and a mounting portion, said mounting portion comprising a front side and a back side, wherein said back side of said mounting portion comprises a plurality of retention holes;

wherein said mounting point is operable to receive said mounting bracket; and wherein said clip is operable to be mounted to said mounting bracket when said mounting bracket is received in said mounting point, wherein said plurality of retention holes are operable to receive said plurality of retention pegs, and wherein said clip is unable to rotate relative to said accessory when said plurality of retention pegs are received by said plurality of retention holes.

2. The adjustable fastening system of claim 1 further comprising a fastener, wherein said fastener is operable to secure said clip to said mounting bracket.

3. The adjustable fastening system of claim 2, wherein said mounting bracket further comprises a threaded hole, wherein said threaded hole is operable to receive said fastener.

4. The adjustable fastening system of claim 3, wherein said clip further comprises a retention member and a tab, and wherein said interior side of said mounting bracket is flat.

5. The adjustable fastening system of claim 1, wherein said accessory is a holster.

6. The adjustable fastening system of claim 1, wherein each retention hole of said plurality of retention holes comprises a plurality of indentations in a surface of said back side of said mounting portion, wherein each plurality of indentations forms an arcuate shape, wherein each indentation of said plurality of indentations is operable to receive a retention peg of said plurality of retention pegs, and wherein said clip is unable to rotate relative to said mounting bracket when each retention peg of said plurality of retention pegs is seated within an indentation of said plurality of indentations.

7. The adjustable fastening system of claim 6, further comprising a fastener, wherein said fastener is operable to secure said clip to said mounting bracket.

8. The adjustable fastening system of claim 7, wherein said mounting bracket further comprises a threaded hole, wherein said threaded hole is operable to receive said fastener.

9. The adjustable fastening system of claim 8, wherein said accessory is a holster.

10. An adjustable fastening system, comprising:

an accessory, said accessory comprising a mounting point, said mounting point comprising a plurality of retention points, wherein each retention point of said plurality of retention points comprises two pegs connected by a bridge; and a clip, said clip comprising a vertical extension and a mounting portion, said mounting portion comprising a front side and a back side, wherein said back side of said mounting portion comprises a plurality of retention holes;

wherein each retention hole of said plurality of retention holes comprises a plurality of semi-open circular indentations arranged in an arcuate shape in a surface of said back side of said mounting portion, and wherein each semi-open circular indentation of said plurality of semi-open circular indentations is operable to receive a peg of a retention point of said plurality of retention points; and wherein said clip is operable to be mounted to said accessory at said mounting point, wherein said plurality of retention holes are operable to receive said plurality of retention points, and wherein said clip is unable to rotate relative to said accessory when said plurality of retention points are received by said plurality of retention holes.

11. The adjustable fastening system of claim 10 further comprising a fastener, wherein said fastener is operable to secure said clip to said mounting point.

12. The adjustable fastening system of claim 11, wherein said mounting point further comprises a threaded hole, wherein said threaded hole is operable to receive said fastener.

13. The adjustable fastening system of claim 12, wherein said clip further comprises a retention member and a tab.

14. The adjustable fastening system of claim 13, wherein said accessory is a holster.

15. The adjustable fastening system of claim 10, wherein each said peg of each said retention point of said plurality of retention points is round.

16. The adjustable fastening system of claim 15, further comprising a fastener, wherein said fastener is operable to secure said clip to said mounting point.

17. The adjustable fastening system of claim 16, wherein said mounting point further comprises a threaded hole, wherein said threaded hole is operable to receive said fastener.

18. The adjustable fastening system of claim 17, wherein said accessory is a holster.

19. An adjustable fastening system, comprising:

a mounting bracket, said mounting bracket comprising a means for fixing the position of a clip; and a clip, said clip comprising a means for receiving said fixing means;

wherein said receiving means is operable to receive said fixing means, and wherein said clip is unable to rotate relative to said mounting bracket when said fixing means are received by said receiving means.

20. The adjustable fastening system of claim 19, further comprising a fastening means, wherein said fastening means is operable to secure said clip to said mounting bracket.

21. An adjustable fastening system, comprising:

an accessory, said accessory comprising a mounting means;

a clip, said clip comprising a means for receiving said mounting means;

wherein said receiving means is operable to receive said mounting means, and wherein said clip is unable to rotate relative to said accessory when said mounting means are received by said receiving means.

22. The adjustable fastening system of claim 21, wherein said accessory is a holster.

* * * * *